United States Patent [19]

Sandstrom et al.

[11] Patent Number: 4,969,386

[45] Date of Patent: Nov. 13, 1990

[54] CONSTRAINED CERAMIC-FILLED POLYMER ARMOR

[75] Inventors: Donald J. Sandstrom, Santa Fe; Noel C. Calkins; Frank D. Gac, both of Los Alamos, all of N. Mex.

[73] Assignee: The United States of America as represented by the United States Department of Energy, Washington, D.C.

[21] Appl. No.: 460,478

[22] Filed: Jan. 3, 1990

Related U.S. Application Data

[63] Continuation-in-part of Ser. No. 321,658, Feb. 28, 1989, abandoned.

[51] Int. Cl.[5] ..... F41H 5/04

[52] U.S. Cl. ..... 89/36.02; 428/911

[58] Field of Search ..... 89/36.02; 428/319.1, 428/911; 109/49.5

[56] References Cited

U.S. PATENT DOCUMENTS

| | | | |
|---|---|---|---|
| 3,509,833 | 5/1970 | Cook | 109/82 |
| 3,616,115 | 10/1971 | Klimmek | 89/36.02 |
| 3,924,038 | 12/1975 | McArdle et al. | 89/36.02 |
| 4,030,427 | 6/1977 | Goldstein | 89/36.02 |
| 4,061,815 | 12/1977 | Poole, Jr. | 428/310 |
| 4,179,979 | 12/1979 | Cook et al. | 89/36.02 |
| 4,186,648 | 2/1980 | Clausen et al. | 89/36.02 |
| 4,198,454 | 4/1980 | Norton | 428/911 |
| 4,232,069 | 11/1980 | Windecker | 428/49 |
| 4,292,882 | 10/1981 | Clausen | 89/36.02 |
| 4,661,559 | 4/1987 | Gardner et al. | 525/107 |
| 4,664,967 | 5/1987 | Tasdeminglu | 428/911 |
| 4,683,800 | 8/1987 | Snedeker | 89/36.02 |
| 4,822,657 | 4/1989 | Simpson | 89/36.02 |
| 4,859,541 | 8/1989 | Maxeiner et al. | 428/911 |

FOREIGN PATENT DOCUMENTS

| | | | |
|---|---|---|---|
| 0024713 | 3/1981 | European Pat. Off. | 89/36.02 |

OTHER PUBLICATIONS

D. S. Drumheller, "On the Dynamical Response of Particulate Loaded Materials. II. A Theory with Application to Alumina Particles in an Epoxy Matrix", J. Appl. Phys. 53(2), 957–969 (Feb. 1982).

*Primary Examiner*—David H. Brown

*Attorney, Agent, or Firm*—Richard J. Cordovano; Paul D. Gaetjens; William R. Moser

[57] ABSTRACT

An armor system in which a plurality of constraint cells are mounted on a surface of a substrate, which is metal armor plate or a similar tough material, such that the cells almost completely cover the surface of the substrate. Each constraint cell has a projectile-receiving wall parallel to the substrate surface and has sides which are perpendicular to and surround the perimeter of the receiving wall. The cells are mounted such that, in one embodiment, the substrate surface serves as a sixth side or closure for each cell. Each cell has inside of it a plate, termed the front plate, which is parallel to and in contact with substantially all of the inside surface of the receiving wall. The balance of each cell is completely filled with a projectile-abrading material, which is a ceramic material in particulate form dispersed in a polymeric matrix.

21 Claims, 2 Drawing Sheets

CONSTRAINED CERAMIC-FILLED POLYMER ARMOR

This invention is the result of a contract with the Department of Energy (Contract No. W-7405-ENG-36).

This application is a continuation-in-part of application Ser. No. 321,658, filed Feb. 28, 1989, now abandoned.

BACKGROUND OF THE INVENTION

This invention relates to impact-resistant material systems.

There are numerous types of armor and armor systems for use in protecting people and equipment from metal fragments, bullets, and other projectiles of various types. Conventional armor is thick steel plate that is formulated and manufactured to have great strength and toughness. It has been necessary to increase the thickness of armor plate in response to advances in projectile technology, but there are limits to the amount of weight due to armor that military equipment, such as tanks. ships, and airplanes, can carry and still be militarily effective. And, of course, personnel armor using any significant amount of steel is not practical.

Numerous types of armor and armor systems that utilize ceramics, polymers, and combinations thereof have been developed. The following patents teach armor which does not rely on steel plate to stop projectiles.

Leo J. Windecker, "Impact Resistant Composite Structure,." U.S. Pat. No. 4,232,069, November 1980. This patent teaches an impact-resistant composite structure comprised of a base portion of several plies of high tensile strength fiber sheets impregnated with an adhesive elastic resin. This flexible base portion of the structure has mounted on it a facing portion (facing an incoming projectile) consisting of a plurality of closely spaced ceramic tiles in a thick layer of an adhesive elastic resin in which microspheres are dispersed. The thickness of the adhesive elastic layer is preferably three times the thickness of the ceramic tiles. The purpose of the microspheres in the adhesive is to isolate the ceramic tiles from each other so that a bullet hitting one tile does not damage adjoining tiles. In another embodiment, the ceramic tiles are covered with several plies of high tensile strength fiber sheets impregnated with an adhesive elastic resin, this portion of the structure being identical to the base portion.

Robert E. J. Poole, Jr., "Novel Compositions," U.S. Pat. No. 4,061,815, December 1977. This patent teaches laminated structures comprised of an outer projectile-receiving layer which is preferably aluminum armor plate, an inner layer of noncellular polyurethane, and an inner skin fabricated from any suitable material, such as aluminum sheet or polyester. In one embodiment a particulate filler, such as gravel, crushed granite, or ceramics, is embedded in the polyurethane layer. Several filled polyurethane layers may be utilized. The polyurethane layer may also contain within it one or more layers of corrugated spring steel strips.

Hugh C. Gardner et al., "Impact Resistant Matrix Resins for Advanced Composites," U.S. Pat. No. 4,661,559, April 1987. This patent teaches composite armors consisting of diamine hardeners, epoxy resins, and thermoplastic polymers.

Carol W. Clausen, "Armor Comprising a Plurality of Loosely Related Sheets in Association with a Frontal Sheet Comprising Metal Abrading Particles." U.S. Pat. No. 4,292,882, October 1981, This patent teaches a flexible light armor comprised of multiple layers, where one layer is comprised of a hard particulate material, such as alumina, in a binder material. In a preferred embodiment, two or more layers of flexible fabric are impregnated with an abrasive material and bonded together with a soft and flexible latex cement.

Richard L. Cook et al., "Ballistic Armor System," U.S. Pat. No. 4,179,979, December 1979. This patent teaches armor consisting of layers of ceramic spheres with a material in sheet form interlaced among the spheres and an adhesive binder filling the voids between the spheres.

Richard J. Cook, "Hard Faced Ceramic and Plastic Armor," U.S. Pat. 3,509,833, May 1970. This patent teaches a ceramic and plastic armor system. Alumina tiles are bonded to a substrate by a flexible bonding agent. The substrate may be layers of resin-impregnated glass fabric or a homogeneous tough plastic material. The tiles are then covered with a flexible material such as ballistic nylon or resin-impregnated glass fabric.

BRIEF SUMMARY OF THE INVENTION

This invention is an armor system, or armor, in which a plurality of constraint cells are mounted on a surface of a substrate, which is metal armor plate or a similar tough material, such that the cells almost completely cover the surface of the substrate. Each constraint cell has a projectile-receiving wall parallel to the substrate surface and has sides which are perpendicular to and surround the perimeter of the receiving wall. The cells are mounted such that, in one embodiment, the substrate surface serves as a sixth side or closure for each cell. In another embodiment, each cell is completely enclosed, by six sides, and the wall parallel to the receiving wall is attached to the substrate. Each cell has inside of it a plate, termed the front plate, which is parallel to and in contact with substantially all of the inside surface of the receiving wall. The balance of each cell is completely filled with a ceramic material in particulate form which is dispersed in a polymeric matrix. A projectile of the size and type against which the armor has been designed to be effective which penetrates the receiving wall and front plate will be abraded to dust by the ceramic as it passes into the filler material.

It is important to the effectiveness of this invention that the cell filler material is completely constrained; the front plate serves a major purpose in maintaining complete constraint. Prior to the present invention, the principle of total constraint was unknown. Also, it is believed that the phenomenon of dilatancy acts in concert with the principle of complete restraint to destroy a projectile.

It is an object of this invention to provide an armor system whose performance is comparable to prior art systems, but which weighs less than conventional steel armor plate and less than prior art armor systems utilizing ceramics.

It is also an object of this invention to provide an armor system which is less expensive than prior art armors.

It is a further object of this invention to provide an armor system that can be easily and quickly repaired on a battlefield.

Also, it is an object of this invention to provide an armor system which can be easily upgraded to accommodate armor design improvements which may be made in the future.

In a broad embodiment, this invention is an armor system comprised of a plurality of constraint cells, each cell being comprised of a hollow rectangular parallelepiped having a projectile-receiving wall and lacking a wall opposite said receiving wall; a substrate having a first surface on which said constraint cells are disposed such that said first substrate surface is substantially covered by constraint cells and provides a closure wall for each constraint cell; a front plate located inside each constraint cell, parallel to and in contact with substantially all of the interior surface of said receiving wall; and projectile-abrading filler material which occupies all of the interior volume of each constraint cell except that volume occupied by said front plate.

In another embodiment, each constraint cell is completely closed by means of six walls and the wall parallel to the receiving wall is attached to the substrate.

In another embodiment, a flexible impact-resistant material is disposed parallel to the first substrate surface and covering the constraint cell receiving walls, so that it is the first portion of the armor system which is contacted by an incoming projectile.

DETAILED DESCRIPTION OF THE INVENTION

Further description of this invention is presented with reference to the drawings. These depict particular embodiments of the invention and are not intended to limit the generally broad scope of the invention as set forth in the claims. All of the drawings are schematics rather than precise representations and are not drawn to scale.

Figure 1:
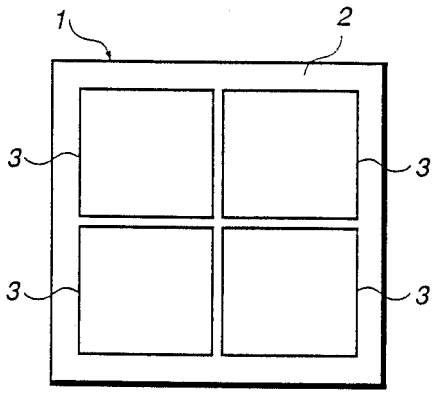
FIG. 1 is a front view of four constraint cells mounted on a substrate, that is, a view of the armor from the perspective of an incoming projectile.

Referring now to FIG. 1, assembly 1 consists of a substrate 2 having disposed on it four constraint cells 3. This armor system is shown in front view, from the perspective of an incoming projectile. It can be seen that constraint cells 3 substantially cover substrate 2, which may be armor plate or another tough and strong material, such as a flexible material comprised of aramid fiber.

Figure 2:
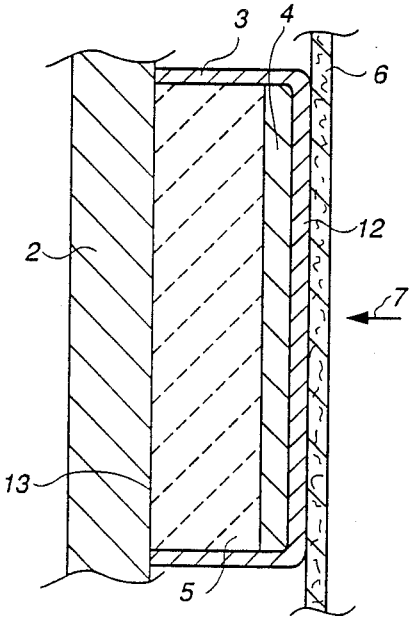
FIG. 2 is a section view depicting one constraint cell on a substrate with a flexible impact-resistant material covering the receiving wall of the cell. Note that there are five different layers of material. The arrow shows the direction of movement of an incoming projectile.

FIG. 2 is a side view with respect to FIG. 1. It is a sectional elevation showing a portion of a substrate 2 with a single constraint cell 3 disposed on it and attached to it. Attachment means are not shown. Constraint cell 3 may be described as a box having five relatively thin walls with one wall missing. Substrate 2 provides a closure wall for constraint cell 3; that is, a surface of the substrate provides the missing wall of the constraint cell, so that the contents of the constraint cell are totally and completely constrained. A flexible impact-resistant material 6 is disposed parallel to projectile-receiving wall 12 of constraint cell 3. Impact-resistant material 6 may be any tough material which may also be effective as armor, such as fabrics comprised of aramid fiber or polymeric resin impregnated with glass or other man-made fibers in one or more layers.

Front plate 4 is a flat metal plate having a surface area substantially the same as the surface area of projectile-receiving wall 12. Projectile-abrading filler material 5 completely fills the interior portion of constraint cell 3 which is not occupied by front plate 4. The constraint cell filler is a mixture consisting of ceramic particles dispersed throughout a polymeric material. A part of the filler in a cell may consist of a pressed coupon of the ceramic/polymer mixture. Additional mixture then is used to fill all space not occupied by the coupon and front plate. The ceramic particles are not spherical; they have flat facets and sharp edges.

The means by which a filled constraint cell is attached to the substrate is not shown. The preferred means of attachment is an adhesive material, preferably an acrylic, which bonds the edges of the cell and the cell filler material to the surface 13 of the substrate. Alternatively, an epoxy bonding material or mechanical attachment means may be used.

Still referring to FIG. 2, arrow 7 depicts the direction of an incoming projectile. Of course, a projectile may not approach at an angle of 90° to the surface of the armor as shown, but may approach at any oblique angle. A projectile will pass through, to the extent that it is able, the layers which comprise the inventive armor in the following order: flexible material 6, receiving wall 12 of constraint cell 3, front plate 4, constraint cell filler 5 and substrate 2. Projectiles having low energy may be stopped by flexible material 6, receiving wall 12, or front plate 4. Flexible material 6, receiving wall 12 and front plate 4 are not necessarily intended to function as armor, though they may be designed to so function. The receiving wall, the side walls of the cell, and the front plate perform the vital function of constraining filler material 5 in combination with the substrate, which provides the missing wall of the constraint cell.

A constraint cell may be fabricated of a metal, a polymer, a glass-reinforced or other man-made fiber-reinforced polymer, materials using aramid or carbon fibers, or similar materials. Where the constraint cell material is not strong enough to constrain the filler material upon projectile impact, the constraint cells may be placed on the substrate such that the side walls of each cell are touching the side walls of other cells in order to provide support for the side walls.

Figure 5:
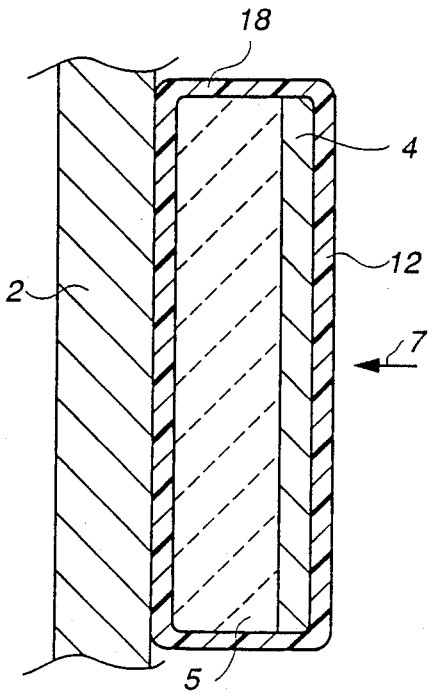
FIG. 5 is a section view similar to FIG. 2 except that FIG. 5 depicts a six-sided closed constraint cell instead of a five-sided cell and the flexible material is omitted from FIG. 5.

FIG. 5 depicts a completely enclosed constraint cell, where the cell has a sixth side and does not require the substrate to provide the closure wall. As in other embodiments, the constraint cell must be completely filled. Reference number 18 denotes the hollow parallelepiped which is the constraint cell and the other reference numbers are as used in the other figures. A completely closed cell may easily be fabricated using filament winding apparatus to encapsulate filler material and a front plate.

Figure 3:
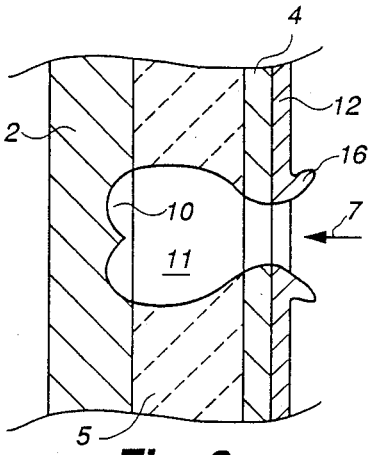
FIG. 3 is a section view depicting an armor system after it has stopped a projectile. Note that there are four different layers of material.

FIG. 3 is a section view which is taken in the same manner as FIG. 2. The flexible material 6 shown in FIG. 2 is omitted from FIG. 3. FIG. 3 depicts cavities 10 and 11 which were formed by a projectile following the flight path indicated by arrow 7. The projectile had sufficient energy to penetrate receiving wall 12, front plate filler materials, and cause the formation of cavity 10 in substrate 2. The projectile was completely destroyed before it physically contacted substrate 2.

Figure 4:
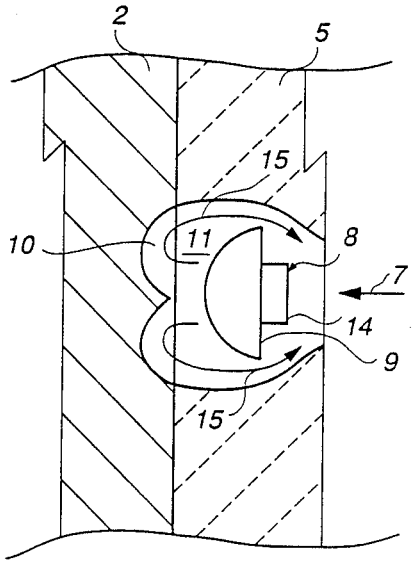
FIG. 4 is a dynamic section view, taken in the same manner as FIGS. 2 and 3, depicting a portion of the armor and a projectile which has been abraded and deformed by the armor as the projectile passes through the filler material and approaches the substrate.

FIG. 4 depicts the dynamic situation as a projectile 8 moves through filler material 5. Note that the components depicted in FIG. 4 are shown in a larger scale than the scale of the other Drawings. Projectile 8 is shown with an undamaged rear portion 14 and a mushroomed head caused by impact with the receiving wall, front plate, and filler. Before contacting the armor system, projectile 8 was cylindrical in form and much longer than is depicted in FIG. 4. As projectile 8 moves through filler material 5, the ceramic material of filler 5 erodes the projectile, converting the metal of the projectile to dust, or fine particles. Also, dust is generated by means of attrition of the ceramic particles. The path of the projectile and ceramic dust is depicted by arrows 15.

Referring to FIGS. 3 and 4, it can be seen that cavity 11 increases in diameter as the distance from the entry point of the projectile increases, in order that the dust be able to pass along side the projectile as the dust moves in an opposite direction from the projectile toward the projectile entry hole in wall 12. Passage of the dust from the projectile and the ceramic through receiving wall 12 deforms the wall as shown by reference number 16 (assuming wall 12 is of metal). As the projectile approaches close to the substrate, the dust of the projectile and the ceramic erode cavity 10 in substrate 2. The projectile of FIG. 3 was completely destroyed before it physically contacted substrate 2.

It can be seen in FIG. 3 that the cross-sectional area of cavity 11, taken in planes parallel to the substrate, is smallest at front plate 4. That is, the hole in the front plate is smaller than the hole in receiving wall 12 or the hole in the filler material or the substrate. The hole in the front plate serves as an orifice for removal of abraded material while the front plate serves the function of completely restraining the filler material as a projectile penetrates the filler material.

A projectile may be stopped by wall 12 or plate 4 if it possesses a relatively low amount of energy or it may contact or penetrate substrate if it possesses a high amount of energy and/or is of a material unusually resistant to erosion. Also, a projectile may be large in comparison to the size of a constraint cell, such that the projectile contacts more than one constraint cell. Normally, the armor system will be designed to counter particular threats, that is, a range of particular size and types of projectiles. A constraint cell receiving wall will be designed to be larger in surface area than the impact area of design threat projectiles. The thicknesses of wall 12, plate 4, and filler 5 will be established to prevent contact of design threat projectiles with substrate 2. Flexible impact-resistant material 6 may be used to initially slow a projectile.

The particle-abrading constraint cell filler is particles of ceramic mixed with, or dispersed throughout, a polymeric material, which is preferably a two-part epoxy. The polymer and ceramic particles may be mixed and placed in a constraint cell while the mixture is fluid. After the mixture cures, or hardens, the constraint cell is fastened to the substrate, preferably by means of an adhesive. Alternatively, the mixture may be pressed and the pressed coupon, or several pressed coupons, placed inside the constraint cell (and held therein with an adhesive, if necessary). When a pressed coupon is used, any void space left in the cell is completely filled with a fluid mixture of polymer and ceramic.

It is essential that a constraint cell have no void space. When a projectile strikes and penetrates a front plate, pressure is thereby exerted on the filler material. It is believed that the filler material then behaves in a dilatant manner, thereby enhancing the erosive effect of the ceramic. The existence of void space would tend to nullify the dilatant effect. It is desirable that the only path available for the metal dust and ceramic dust formed as a projectile passes through the filler material be through the hole created by the projectile, so that it further abrades the projectile.

The Table appearing herein shows the results of experiments in which two embodiments of the invention (Series 3 and 4) and two alternatives to the present invention (Series 1 and 2) were tested in four series of experiments. The test results presented in the Table are not given in units such as ft./sec., etc, but are comparative; performance of the Series 2, 3, and 4 armors are presented relative to the performance of the Series 1 armor. In each experiment a 2 $\frac{1}{8}$ in.×2$\frac{1}{8}$ in.×1$\frac{3}{8}$ in. (5.4×5.4×3.49 cm thick constraint cell fabricated of $\frac{1}{8}$ in. (3.18 mm) thick steel was used. A front plate having a thickness of $\frac{1}{4}$ in. (6.35 mm) was used, leaving space for 1 in. (2.5 cm) of filler material. The filled constraint cell was mounted on a $\frac{3}{4}$ in. (1.9 cm) thick substrate of armor plate by means of an epoxy adhesive. A collar, consisting of a 1 in. thick steel plate having a square opening slightly larger than the constraint cell is placed around the cell and fastened to the substrate in order to mimic the presence of cells around the test cell. Four different constraint cell filler materials were tested, as shown in the Table.

TABLE

| Series | $V_{50}$ | $E_m$ | $V_{50}$/mass |
|---|---|---|---|
| 1. Monolithic alumina coupons | 1.00 | 1.00 | 1.00 |
| 2. Monolithic TiB2 coupons | 1.13 | 1.16 | 1.03 |
| 3. Commercial grout and alumina, hand packed | 0.90 | 0.86 | 0.95 |
| 4. Particulate alumina and epoxy, coupons | 0.93 | 0.95 | 1.01 |

In Series 1, 2, and 4 tests, the cells contained four $\frac{1}{4}$ in. thick×2 in.×2 in. (0.635×5.08×5.08 mm) coupons. Four coupons instead of a single 1 in. (2.5 cm) thick coupon were used because titanium diboride was available only in $\frac{1}{4}$ in. (6.35 mm) coupons at that time. All voids in each cell were filled with a material having the trade name Ceramic S Metal (referred to herein as commercial grout) to which was added additional particles of alumina. The commercial grout is an epoxy material having dispersed in it alumina in particulate form and, it is believed, iron oxide particles, which is used in grouting heavy machinery and is available from Belzona Molecular Corporation. The density of the commercial grout was about 2.8 g/cm$^3$ and the density was increased when additional alumina was added. Sufficient alumina was added such that the added material was 25% by volume of the mixture utilized in making the armor. The added alumina particles had two different nominal particle sizes, 1.4–2.4 mm and about 0.25 mm.

In the Series 1 and 2 experiments, monolithic coupons of pure alumina and pure titanium diboride were used. The Series 4 coupons consisted of a commercially available epoxy (trade name Epon Novolac) and alumina particles having three different nominal particle sizes, 1.4–2.4 mm, about 0.25 mm, and about 0.06 mm. The pressed Series 4 coupons had a density of about 3.09 g/cm$^3$ and contained about 88 vol % alumina. The Series 4 coupons were cold-pressed at about 1200 psi (8273 kPa).

Series 3 cells were filled, by hand, with the mixture of commercial grout and added alumina discussed above; the mixture hardened in the cell. This is the preferred method of filling. The preferred filler material is a mixture of epoxy and alumina which does not harden until it is packed into the cell.

One projectile was fired at each constraint cell and entered the cell at about its center and perpendicular to the receiving wall of the constraint cell. The projectiles were standard quarter-scale tungsten penetrators. Projectiles were fired at a sufficient number of constraint cells to establish the average velocity at which one-half of the projectiles were stopped and one-half penetrated the rear face of the substrate; this is known as $V_{50}$. The normalized velocity established for each series is shown in the column of the Table labeled $V_{50}$. To establish normalized values, each velocity was divided by the Series 1 velocity. The normalized relative areal mass, $E_m$, is shown in the Table for each embodiment; this is the mass per unit area of steel armor having the same response as the armor under test divided by the mass per unit area of the armor of the present invention and then normalized using Series 1 as the base case. The Table also presents the normalized quantity $V_{50}$ divided by the mass of the armor sample under test; this is a measure of armor performance related to armor weight. $E_m$ and $V_{50}$/mass were normalized in the same manner as $V_{50}$.

All four of the tested armors are superior to a steel armor system in that they perform as well as steel armor but weigh much less; this can be seen by reference to the raw $E_m$ values.

The titanium diboride armor (Series 2) provides the best performance, but monolithic $TiB_2$ is extremely expensive compared to the other tested materials and, for that reason, is impractical to use except in special situations where cost is not an important factor. The armor of Series 1 is moderately priced and provides a reasonable-cost alternative to Series 2 armor. The inventive armors (Series 3 and 4) are much cheaper, though, and provide performance which is almost equal to the Series 1 and Series 2 armors. Note that Series 4 utilizes coupons plus a hand-packed mixture of polymer and alumina, whereas in Series 3 only the hand-packed mixture of epoxy and particles is used. The preferred Series 3 embodiment is easier to manufacture because forming coupons is not part of the required manufacturing process.

Armor of the present invention can easily be repaired in the field. Spare constraint cells can be carried in an armored vehicle; they can easily be epoxied to a substrate to replace damaged or missing cells. Unfilled constraint cells and alumina mixed with one component of a two-component epoxy can be stored at a forward maintenance facility; the second component (hardener) of the epoxy can be added and the constraint cells filled and attached to the substrate while other repairs are made to an armored vehicle.

As discussed above, it can be appreciated that the size of the components of the inventive armor is dependent upon the application. It is expected that a constraint cell receiving wall will have a surface area of from about 1 in.$^2$ to about 150 in.$^2$ (6.45–968 cm$^2$) and a thickness of about 1/16 to about ½ in. (1.58–12.7 mm). The thickness of a constraint cell receiving wall depends on the surface area of the receiving wall, other characteristics of the cell, and the thickness of the front plate. The thickness of a front plate is expected to be from about ⅛ in. to about 1 in. (0.32–2.54 cm). It is expected that the thickness of the substrate will be from about ¼ in. to about 4 in. (0.64–10.16 cm). It is expected that the maximum spacing of constraint cells on a substrate will be such that every point of the surface of the substrate will be within a very small distance of a constraint cell, preferably from 0 to about ⅛ in. (3.18 mm); that is, spaces between constraint cells will be preferably no more than about ⅛ in. (3.18 mm). It is expected that the filler will be effective when the ceramic content is from about 50 to about 90 vol % and filler thickness is from about ¼ to about 4 in. (0.64–10.16 cm).

An epoxy may be defined as any of various resins, usually thermosetting, which are capable of forming tight cross-linked polymer structures characterized by toughness, strong adhesion, and high corrosion and chemical resistance. Dilatancy is an increase in volume of a fixed amount of a material when a force is applied to the material. Monolithic, or monolith, as used herein, refers to a single piece of ceramic material which is in the as-fired condition and is relatively large compared to particulates, and generally has flat surfaces.

The foregoing has been presented for purposes of illustration and description. It is not intended to be exhaustive or to limit the invention to the precise form discussed above, since many variations are possible in light of the above teaching.

What is claimed is:

1. An armor system comprised of:

a. a plurality of constraint cells, each cell being comprised of a hollow rectangular parallelepiped having a projectile-receiving wall and lacking a wall opposite said receiving wall;

b. a substrate having a first surface on which said constraint cells are disposed such that said first substrate surface is substantially covered by constraint cells and provides a closure wall for each constraint cell;

c. a front plate located inside each constraint cell, parallel to and in contact with substantially all of the interior surface of said receiving wall; and d. projectile-abrading filler material which occupies all of the interior volume of each constraint cell except that volume occupied by said front plate, where said projectile-abrading filler material is a ceramic material in particulate form dispersed in a polymeric material.

2. The armor system of claim 1 where the amount of said ceramic material present in said filler material is from about 50 to about 90 vol %.

3. The armor system of claim 1 wherein the particle size of said ceramic material is from about 0.06 to about 2.4 mm.

4. The armor system of claim 1 where said ceramic material is aluminum oxide having nominal particle sizes of about 1.4–2.4 mm, 0.25 mm, and 0.06 mm.

5. The armor system of claim 1 where said polymeric material is an epoxy.

6. The armor system of claim 1 where said ceramic material is chosen from a group comprising aluminum oxide, silicon carbide, titanium diboride, and boron carbide.

7. The armor system of claim 1 where a constraint cell is fabricated of a metal.

8. The armor system of claim 1 where a constraint cell is fabricated of a polymeric material.

9. The armor system of claim 1 where a constraint cell is fabricated of a glass-reinforced polymer.

10. The armor system of claim 1 where a constraint cell projectile-receiving wall has a surface area of from about 1 to about 150 in.$^2$ (6.5–968 cm$^2$).

11. The armor system of claim 1 where a constraint cell projectile-receiving wall has a thickness of from about 1/16 to about ½ in. (1.58–12.7 mm).

12. The armor system of claim 1 where every point on said first substrate surface is within from 0 to about 3.18 mm of a constraint cell.

13. The armor system of claim 1 where a front plate is a metal.

14. The armor system of claim 1 where a front plate is a nonmetallic material.

15. The armor system of claim 1 where a front plate has a thickness of from about ⅛ to about 1 in. (0.32–2.54 cm).

16. The armor plate of claim 1 where each cell has an additional wall which is a closure wall parallel to the projectile-receiving wall and parallel to the substrate.

17. The armor system of claim 1 where the thickness of said filler material in said constraint cell is from about ¼ to about 4 in. (0.64–10.16 cm).

18. The armor system of claim 1 where said substrate is a metal.

19. The armor system of claim 1 where the thickness of said substrate is from about ¼ to about 4 in. (0.64–10.16 cm).

20. The armor system of claim 1 where said substrate is a flexible impact-resistant material.

21. The armor system of claim 1 further including a flexible impact-resistant material disposed parallel to said first substrate surface and covering said constraint cell projectile-receiving walls.

* * * * *